US007292505B2

(12) United States Patent
Schmiedchen

(10) Patent No.: US 7,292,505 B2
(45) Date of Patent: Nov. 6, 2007

(54) INSTRUMENT FOR MEASURING INTERVALS OF TIME COMPRISING A RINGING MECHANISM

(75) Inventor: Christian Schmiedchen, Reichstädt (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 125 days.

(21) Appl. No.: 11/311,156

(22) Filed: Dec. 20, 2005

(65) Prior Publication Data

US 2006/0133217 A1 Jun. 22, 2006

(30) Foreign Application Priority Data

Dec. 20, 2004 (EP) ..... 04030204

(51) Int. Cl.
*G04F 8/00* (2006.01)
*G04F 10/00* (2006.01)

(52) U.S. Cl. ..... 368/110

(58) Field of Classification Search ..... 368/101–113
See application file for complete search history.

(56) References Cited

U.S. PATENT DOCUMENTS 3,210,925 A * 10/1965 Hepler ..... 368/106
4,216,649 A 8/1980 Ichikawa et al.
5,289,452 A * 2/1994 Sakamoto et al. ..... 368/73
2007/0058492 A1* 3/2007 Carley ..... 368/109

FOREIGN PATENT DOCUMENTS

CH 15452 10/1897
CH 43949 4/1908

OTHER PUBLICATIONS

Reymondin, Charles-Andre et al., "Mechanismes de chronographe", Theorie d'horlogerie, pp. 225-252, 1988, Federation des ecoles techniques.

European Search Report in corresponding application No. EP 04 03 0204 completed Sep. 7, 2005.

* cited by examiner

*Primary Examiner*—Gary Paumen
(74) *Attorney, Agent, or Firm*—Griffin & Szipl, P.C.

(57) ABSTRACT

Instrument for measuring intervals of time including a chronograph mechanism (4) which it is possible at least to start, stop and reset to zero, said instrument (1) being characterized in that it further includes a ringing mechanism (6) which emits an acoustic signal at least when the chronograph mechanism (4) is started.

30 Claims, 3 Drawing Sheets

INSTRUMENT FOR MEASURING INTERVALS OF TIME COMPRISING A RINGING MECHANISM

This application claims priority from European Patent Application No. EP 04030204.4 filed Dec. 20, 2004, the entire disclosure of which is incorporated herein by reference.

FIELD OF THE INVENTION

The present invention concerns an instrument for measuring intervals of time comprising a ringing mechanism. More specifically, the present invention concerns a timepiece comprising a chronograph mechanism. This type of timepiece can be either a pocket watch, a wristwatch, or a sports or industrial counter, which has the peculiarity of not indicating the current time and which is not only being used for measuring intervals of time.

BACKGROUND OF THE INVENTION

The chronograph is a complementary mechanism, added to the movement of a watch, which measures the time elapsed during a sports event, industrial operations, laboratory experiments or any other application that requires timing an operation. An application of pressure on a push-button starts and stops the chronograph hand. An additional application of pressure on another push-button is used to return the hand to zero. Depending upon the degree of complication of the chronograph mechanism, one could also envisage restarting the mechanism after a temporary halt or a fly-back hand.

The drawback observed with the chronograph mechanisms that are currently available on the market is that they are started without any noise. This is particularly disadvantageous, for example for a sports coach, who will tend to look away from the athlete to ensure that his chronograph mechanism has actually started, a reflex which can cause measurement errors. The same is true for the measurement of any physical industrial or laboratory phenomenon. The person responsible for taking the measurement instinctively tends to look at the chronograph in order to ensure that it is working and stops looking at the phenomenon that he or she is supposed to be observing.

It is an object of the present invention to overcome this drawback in addition to others by providing a chronograph mechanism which enables its user to know whether the chronograph mechanism has been started properly without having to look away from the event whose duration has to be measured.

SUMMARY OF THE INVENTION

The present invention therefore concerns an instrument for measuring intervals of time comprising a chronograph mechanism, which is at least able to be started, stopped and reset to zero, this instrument being characterized in that it further includes a ringing mechanism which emits an acoustic signal at least when the chronograph mechanism is started.

Owing to these features, the present invention provides an instrument for measuring intervals of time that informs its user that the chronograph mechanism has been started by emission of a ringing sound. The user is thus informed audibly that the chronograph mechanism has been properly started and can thus keep his eyes on the event whose duration he wishes to time.

The ringing sounds at least when the chronograph mechanism is being started. It is, however, perfectly possible to envisage the ringing occurring when the user presses on a control member to stop the chronograph mechanism and/or to reset it.

For this purpose, and according to a complementary feature of the invention, the chronograph mechanism includes a column wheel associated with a control member which has teeth the number of which is equal to or twice the number of columns of the column wheel and which activates the ringing mechanism at least when the chronograph mechanism is started.

When the number of teeth of the control element is equal to the number of columns of the column wheel, the ringing only sounds when the chronograph mechanism is started, whereas if the number of teeth is equal to twice the number of columns, the ringing sounds when the chronograph mechanism is started and when it is stopped.

BRIEF DESCRIPTION OF THE DRAWINGS

Other features and advantages of the present invention will appear more clearly from the following detailed description of an example embodiment of the instrument for measuring time intervals according to the invention, this example being given purely by way of non-limiting illustration, in conjunction with the annexed drawing, in which.

DETAILED DESCRIPTION OF ILLUSTRATIVE EMBODIMENTS

The present invention proceeds from the general inventive idea that consists in associating a conventional chronograph mechanism with a ringing mechanism that emits an acoustic signal at least when the chronograph mechanism is started and, preferably, also when said chronograph mechanism is stopped. The user who starts or stops the chronograph mechanism therefore benefits from an audible acknowledgement that enables him to be sure that said chronograph mechanism has worked properly without him having to take his eyes off the sports, industrial or other event that he has to time for a single moment. The accuracy of the measurement is therefore substantially increased.

The present invention will be described in relation to a wristwatch. It goes without saying that the invention can be applied to any type of timepiece such as, particularly, a pocket watch. More generally, the invention can be applied to any instrument such as a sports or industrial counter which comprises a time base but whose purpose is not to display the current time but only to measure an elapsed time.

The chronograph mechanism with which the ringing mechanism according to the invention is associated will not be described here in detail. It is in fact a conventional type chronograph mechanism with a column wheel that is well known to those skilled in the art. One will simply recall for the purposes of the present invention that this type of chronograph mechanism essentially includes a column wheel manufactured in a single piece and made up of a ratchet toothing and columns made perpendicularly to the toothing. When the chronograph mechanism is started, an operating lever hook rotates the ratchet of the column wheel through one step. At the same time, the beak of a coupling lever falls into a space between two columns, which causes a coupling wheel driven by the motion work to mesh with the chronograph wheel set. When the chronograph mechanism stops, the operating lever hook the operating lever hook again rotates the ratchet of the column wheel through another step. A brake-lever falls via its beak into a space of the column wheel and presses on the chronograph wheel set, stopping the latter. Simultaneously, the coupling wheel moves away from the chronograph wheel set. Finally, when the chronograph mechanism is reset, a hammer strikes a heart-piece fixedly secured to the chronograph wheel set, thus enabling the chronograph hand to return. For a complete description of a chronograph mechanism, reference can usefully be made to the collective work entitled "Théorie d'horlogerie" published in 1988 in Editions de la Fédération des Ecoles Techniques (Switzerland) which is incorporated herein by reference.

Figure 1:
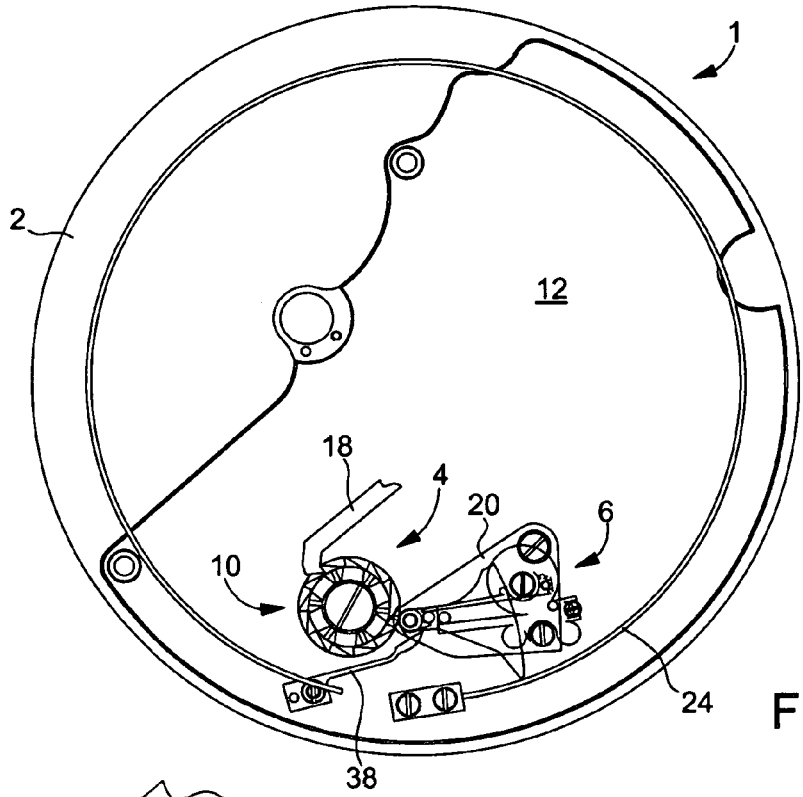
FIG. 1 is a schematic plan view of a watchcase housing a chronograph mechanism and a ringing mechanism.
Figure 2:
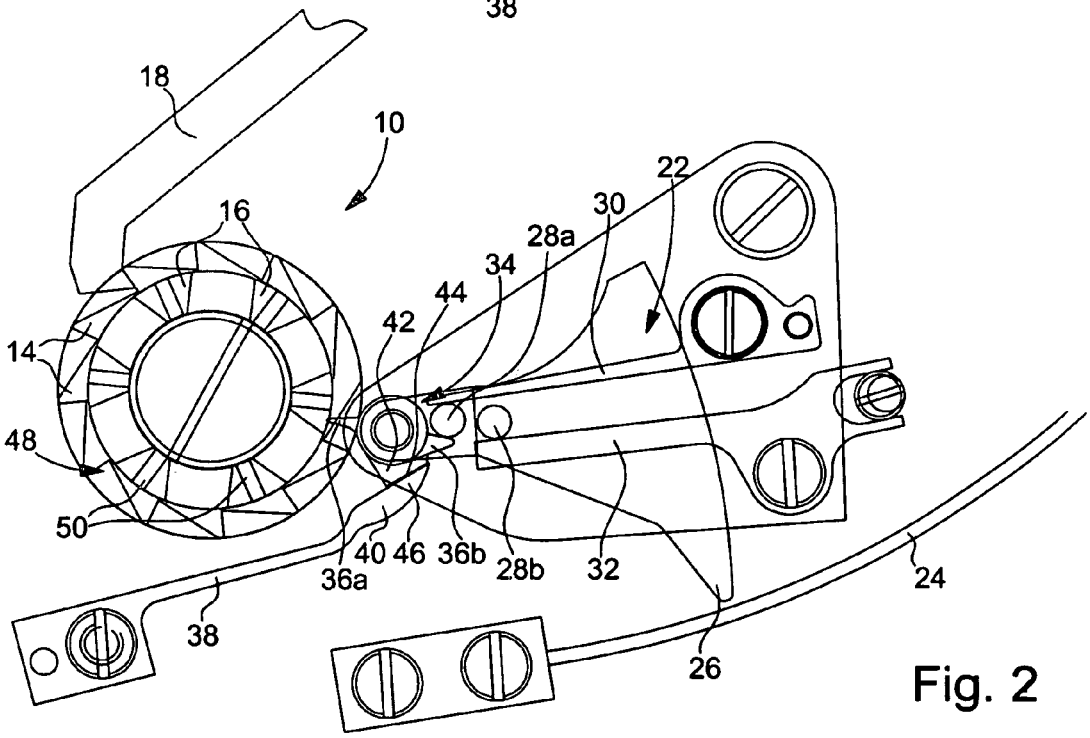
FIG. 2 is a larger scale view of the zone surrounded by a circle in FIG. 1 showing the column wheel of the chronograph mechanism and the ringing mechanism associated therewith.
Figure 3:
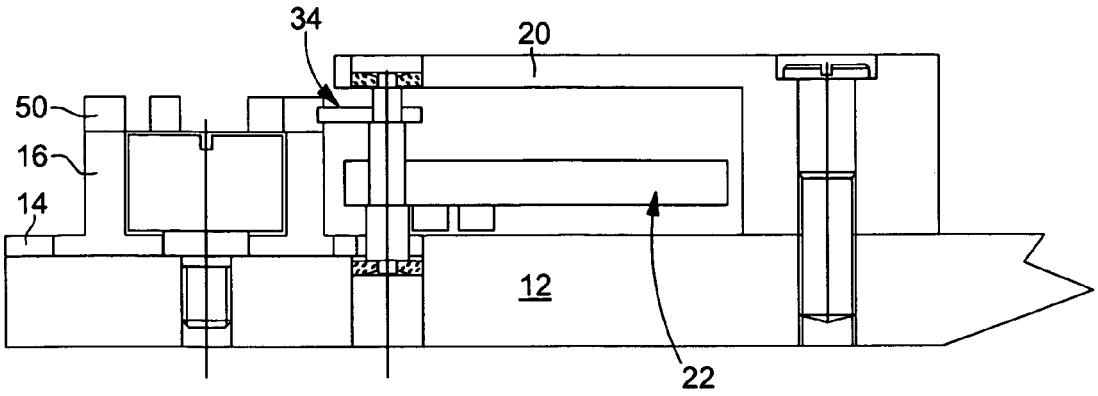
FIG. 3 is an elevation view of the chronograph mechanism and the ringing mechanism.

A first embodiment of a wristwatch according to the invention is shown in conjunction with FIGS. 1 to 3. Designated as a whole by the general reference numeral 1, this wristwatch includes a case 2 which houses a chronograph mechanism 4 and a ringing mechanism 6.

Chronograph mechanism 4 essentially includes a column wheel 10 pivoting on a plate 12. This column wheel 10 is manufactured in one piece and is formed of one toothing 14 called the ratchet and columns 16 made perpendicularly to toothing 14. Every time the chronograph mechanism is operated (start; stop; reset), an operating lever hook 18 causes ratchet 14 of column wheel 10 to rotate through one step clockwise.

Ringing mechanism 6 is mounted on a bridge 20 and essentially includes a strike hammer 22 pivoting on bridge 20 and capable of striking a gong 24 via its head 26. Two pins 28*a* and 28*b*, secured to strike hammer 22, respectively cooperate with an activating spring 30 and a return spring 32, the roles of which will be described hereinafter.

The chronograph mechanism 4 is kinematically linked to ringing mechanism 6 via a release lever 34 pivoting between bridge 20 and plate 12 and which has two diametrically opposite radial arms 36*a* and 36*b*. The position of release lever 34 is indexed by a jumper spring 38 which abuts via its beak-shaped free end 40 against an extension 42 of said release lever 34. More specifically, extension 42 has a flat portion 44 parallel to plate portion 46 of beak 40 of jumper spring 38.

A control element 48 is associated with column wheel 10. According to a first variant illustrated in FIG. 3, this control element 48 includes a number of teeth 50 equal to the number of columns 16 of column wheel 10. These teeth 50 which are above columns 16 can be made in a single piece with said columns 16. Control element 48 could also be made in the form of a separate ring on whose surface the regularly spaced teeth 50 stand and which is fixed to the apex of columns 16 by any appropriate means.

Figure 4:
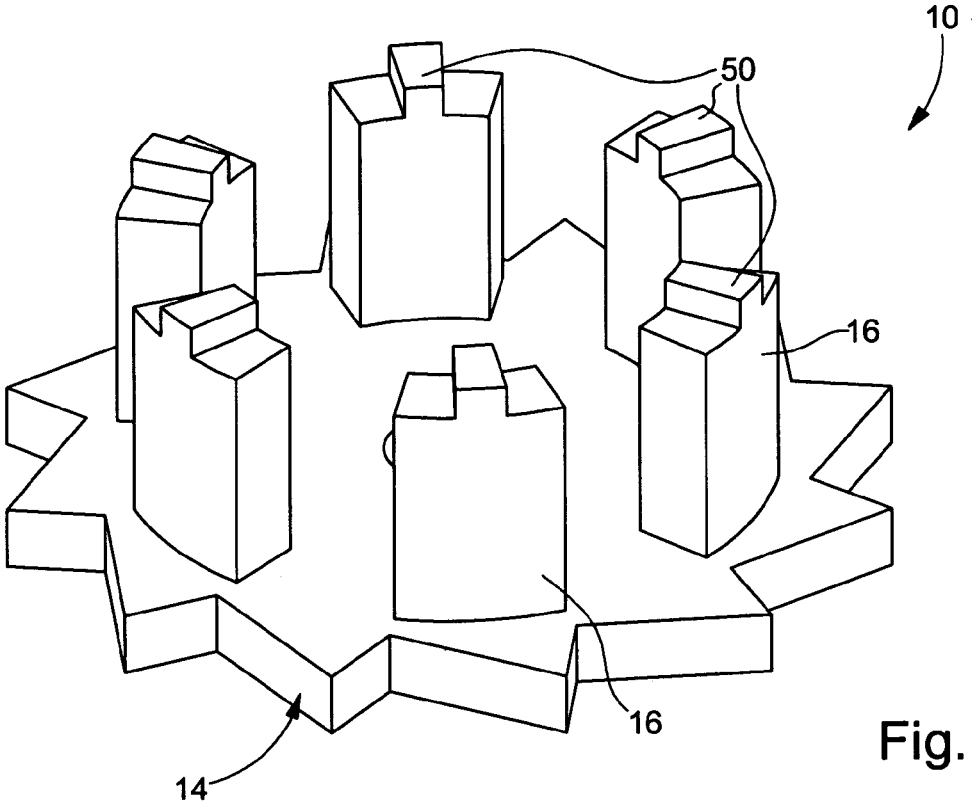
FIG. 4 is a perspective view of a first embodiment of the column wheel and the control element associated therewith.
Figure 5:
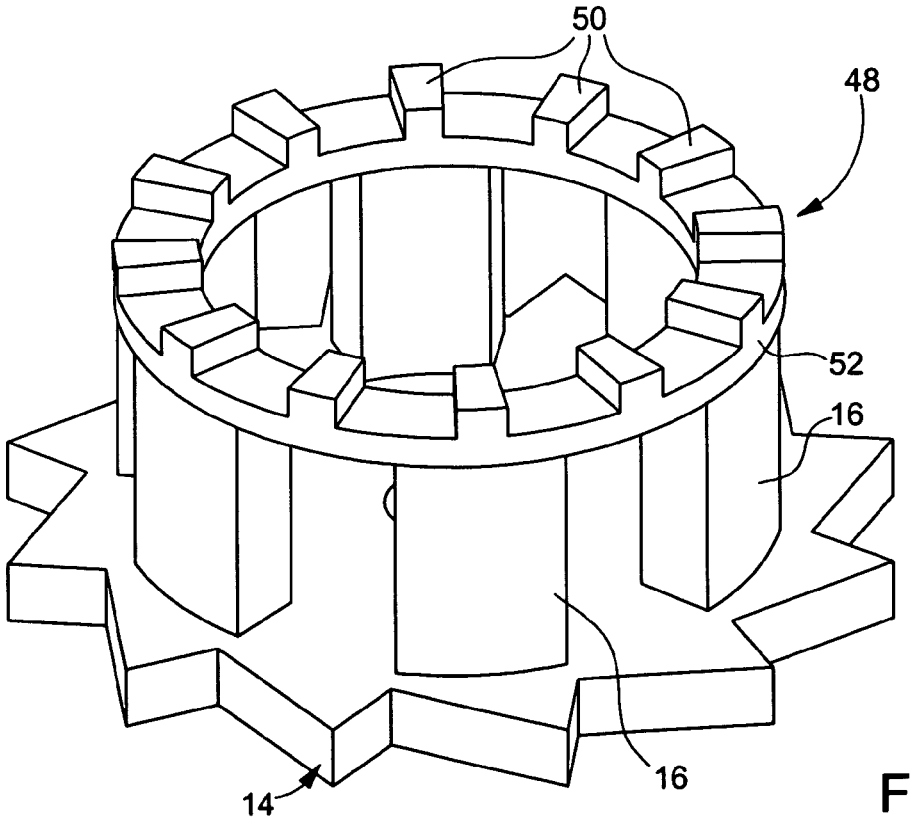
FIG. 5 is a perspective view of a second embodiment of the column wheel and the control element associated therewith.

According to a second variant shown in FIG. 4, control element 48 includes a number of teeth 50 equal to double the number of columns 16. As is visible in FIG. 4, control element 48 is made in the form of a ring 52 on whose surface stand regularly spaced teeth 50. This ring 52 is secured by any appropriate means to the apex of columns 16, such that one tooth in two is located above a column 16, whereas the following tooth is above a space between two successive columns 16.

The operation of the mechanism described hereinbefore is as follows. When chronograph mechanism 4 is started, operating lever hook 18 rotates ratchet 14 of column wheel 10 through one step clockwise. At the same time, control element 48 causes release lever 34 to pivot anti-clockwise, a tooth 50 located at the apex of a column 16 abutting against arm 36*a* of said lever 34 and moving the latter away from its rest position against the return force of jumper spring 38. Likewise, release lever 34 moves strike hammer 22 away, via its arm 36*b*, from its rest position driving pin 28*b* against the return force of activating spring 30. Gradually as release lever 34 pivots, its arm 36*a* slides along the tooth 50 with which it is meshed until the moment when arm 36*a* escapes from said tooth 50. At that moment, activating spring 30 is let down abruptly and drives strike hammer 22 via pin 28*b*, against gong 24. The ringing sounds at the precise moment that operating lever hook 18 passes from one tooth of ratchet 14 to the next, which causes chronograph mechanism 4 to start. After hammer 22 has struck gong 24, it is returned to its rest position by return spring 32 which acts on pin 28*b*, whereas release lever 34 also returns to its rest position via the effect of jumper spring 38.

When chronograph mechanism 4 stops, operating lever hook 18 causes ratchet 14 to move forward one additional step. At that moment, arm 36*a* of release lever 34 is in a space between two successive columns 16. In the case where the number of teeth 50 is equal to the number of columns 16, the ringing will not sound when chronograph mechanism 4 stops. Conversely, if the number of teeth 50 is twice the number of columns 16, one of the teeth, integral with ring 52, will be in the space between the two columns 16, and ringing mechanism 6 will be released in the manner described hereinbefore when chronograph mechanism 4 stops.

Figure 6:
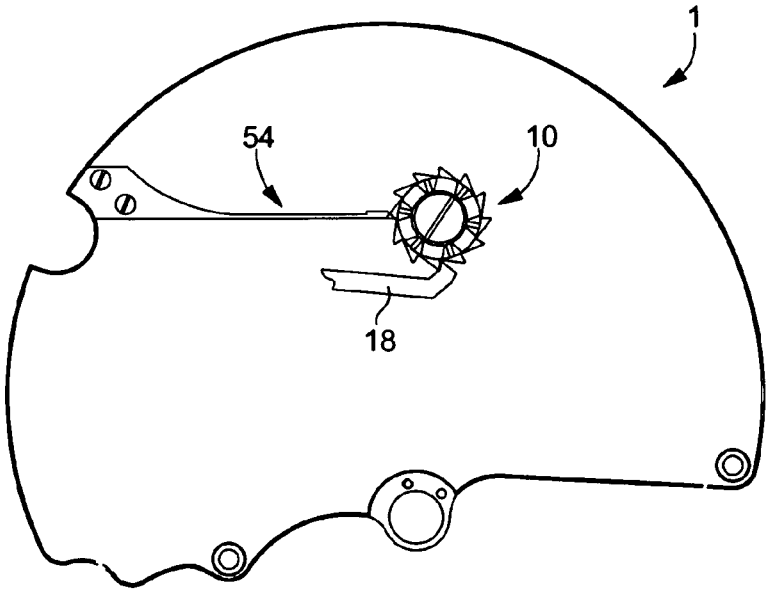
FIG. 6 is a schematic plan view of a second embodiment of the chronograph mechanism and the ringing mechanism associated therewith.

A second embodiment of ringing mechanism 6 according to the invention is shown in FIG. 6. In this embodiment, ringing mechanism 6 includes a strip spring 54 which is moved away from its rest position by being elastically deformed during passage of a tooth 50. After the tooth 50 has passed the end of strip spring 54, the latter is abruptly let down and produces a ringing sound, then returns to its rest position until the next tooth 50 passes.

It goes without saying that the present invention is not limited to the embodiments that have just been described and that various simple modifications and variants can be envisaged by those skilled in the art without departing from the scope of the invention as defined by the annexed claims. In particular, it is possible to envisage the teeth being arranged in a location along the height of the columns, rather than at the apex of the latter.

What is claimed is

1. An instrument for measuring intervals of time including a chronograph mechanism which it is possible at least to start, stop and reset to zero, wherein said instrument further includes a ringing mechanism which emits an acoustic signal at least when the chronograph mechanism is started.

2. The instrument according to claim 1, wherein the chronograph mechanism includes a column wheel associated with a control element which has teeth the number of which is equal to or two times greater than the number of columns of the column wheel and which activates the ringing mechanism at least when the chronograph mechanism is started.

3. The instrument according to claim 2, wherein the teeth are made in one piece with the columns.

4. The instrument according to claim 2, wherein the control element includes a ring on whose surface the teeth stand and which is fixed to the columns.

5. The instrument according to claim 2, wherein the control element acts on the ringing mechanism via a release lever that is capable of pivoting and which has two diametrically opposite radial arms.

6. The instrument according to claim 3, wherein the control element acts on the ringing mechanism via a release lever that is capable of pivoting and which has two diametrically opposite radial arms.

7. The instrument according to claim 4, wherein the control element acts on the ringing mechanism via a release lever that is capable of pivoting and which has two diametrically opposite radial arms.

8. The instrument according to claim 5, wherein the control element controls the pivoting of the release lever by acting on the arm of said lever via one of its teeth, said lever moving, via its arm, a strike hammer away from its rest position against the return force of an activating spring.

9. The instrument according to claim 8, wherein, gradually as the release lever pivots, the arm thereof slides along the tooth with which it is meshed until the moment when said arm escapes from said tooth, the activating spring then being let down and driving the hammer against a gong.

10. The instrument according to claim 8, wherein the release lever drives a pin secured to the strike hammer.

11. The instrument according to claim 9, wherein the release lever drives a pin secured to the strike hammer.

12. The instrument according to claim 5, wherein the position of the release lever is indexed by a spring.

13. The instrument according to claim 8, wherein a return spring acting on a pin secured to the strike hammer returns said hammer to its rest position.

14. Instrument according to claim 2, wherein the ringing mechanism includes a strip spring which is moved away from its rest position when a tooth passes and which is then let down to strike a gong, and which is then returned to its rest position until the passage of the next tooth.

15. An instrument for measuring intervals of time including a chronograph mechanism which it is possible at least to start, stop and reset to zero, wherein said instrument further includes a ringing mechanism which emits an acoustic signal at least when the chronograph mechanism is started, the chronograph mechanism including a column wheel associated with a control element which has teeth the number of which is equal to or two times greater than the number of columns of the column wheel and which activates the ringing mechanism at least when the chronograph mechanism is started, the teeth being made in one piece with the columns, the control element acting on the ringing mechanism via a release lever that is capable of pivoting and which has two diametrically opposite radial arms, the control element controlling the pivoting of the release lever by acting on the arm of said lever via one of its teeth, said lever moving, via its arm, a strike hammer away from its rest position against the return force of an activating spring, wherein, gradually as the release lever pivots, the arm thereof slides along the tooth with which it is meshed until the moment when said arm escapes from said tooth, the activating spring then being let down and driving the hammer against a gong.

16. The instrument according to claim 15, wherein the release lever drives a pin secured to the strike hammer.

17. The instrument according to claim 16, wherein the release lever drives a pin secured to the strike hammer.

18. The instrument according to claim 15, wherein the position of the release lever is indexed by a spring.

19. The instrument according to claim 16, wherein the position of the release lever is indexed by a spring.

20. The instrument according to claim 17, wherein the position of the release lever is indexed by a spring.

21. The instrument according to claim 15, wherein a return spring acting on a pin secured to the strike hammer returns said hammer to its rest position.

22. Instrument according to claim 15, wherein the ringing mechanism includes a strip spring which is moved away from its rest position when a tooth passes and which is then let down to strike a gong, and which is then returned to its rest position until the passage of the next tooth.

23. An instrument for measuring intervals of time including a chronograph mechanism which it is possible at least to start, stop and reset to zero, wherein said instrument further includes a ringing mechanism which emits an acoustic signal at least when the chronograph mechanism is started, the chronograph mechanism including a column wheel associated with a control element which has teeth the number of which is equal to or two times greater than the number of columns of the column wheel and which activates the ringing mechanism at least when the chronograph mechanism is started, the control element including a ring on whose surface the teeth stand and which is fixed to the columns, the control element acting on the ringing mechanism via a release lever that is capable of pivoting and which has two diametrically opposite radial arms, the control element controlling the pivoting of the release lever by acting on the arm of said lever via one of its teeth, said lever moving, via its arm, a strike hammer away from its rest position against the return force of an activating spring, wherein, gradually as the release lever pivots, the arm thereof slides along the tooth with which it is meshed until the moment when said arm escapes from said tooth, the activating spring then being let down and driving the hammer against a gong.

24. The instrument according to claim 23, wherein the release lever drives a pin secured to the strike hammer.

25. The instrument according to claim 24, wherein the release lever drives a pin secured to the strike hammer.

26. The instrument according to claim 23, wherein the position of the release lever is indexed by a spring.

27. The instrument according to claim 24, wherein the position of the release lever is indexed by a spring.

28. The instrument according to claim 25, wherein the position of the release lever is indexed by a spring.

29. The instrument according to claim 23, wherein a return spring acting on a pin secured to the strike hammer returns said hammer to its rest position.

30. Instrument according to claim 23, wherein the ringing mechanism includes a strip spring which is moved away from its rest position when a tooth passes and which is then let down to strike a gong, and which is then returned to its rest position until the passage of the next tooth.

* * * * *